United States Patent [19]

Palmlund

[11] Patent Number: 4,828,412

[45] Date of Patent: May 9, 1989

[54] FEED MEANS FOR CARBON RIBBON

[75] Inventor: Sven-Tore Palmlund, Skyttevägen, Sweden

[73] Assignee: Facit Aktiebolag, Sundbyberg, Sweden

[21] Appl. No.: 127,434

[22] Filed: Dec. 2, 1987

[30] Foreign Application Priority Data

Dec. 2, 1986 [SE] Sweden ..... 8605172

[51] Int. Cl.[4] ..... B41J 35/28

[52] U.S. Cl. ..... 400/208

[58] Field of Search ..... 400/207, 208, 208.1, 400/236, 236.2, 243, 194, 196, 196.1, 235.1

[56] References Cited

U.S. PATENT DOCUMENTS

| | | | |
|---|---|---|---|
| 4,353,658 | 10/1982 | Craft | 400/208 |
| 4,423,974 | 1/1984 | Muller et al. | 400/196 |
| 4,605,325 | 8/1986 | Hofmann | 400/208 |
| 4,606,662 | 8/1986 | Komplin | 400/208 |
| 4,756,635 | 7/1988 | Frerichs | 400/236 |

FOREIGN PATENT DOCUMENTS

| | | | |
|---|---|---|---|
| 1966956 | 8/1975 | Fed. Rep. of Germany | 400/208 |
| 2810768 | 9/1979 | Fed. Rep. of Germany | 400/208 |
| 176080 | 10/1984 | Japan | 400/208 |

OTHER PUBLICATIONS

"Cartridge-Handling Station", IBM Technical Disclosure Bulletin, vol. 26, No. 7, Dec. 1983, pp. 3814–3815.

*Primary Examiner*—Eugene H. Eickholt

*Attorney, Agent, or Firm*—Burns, Doane, Swecker & Mathis

[57] ABSTRACT

In an arrangement for feeding carbon ribbons and the like a dog (3) is arranged inside a feed reel (1) for the carbon ribbon (2) of a typewriter. The dog (3) has the form of a cylinder with two projecting flanges (4,5) extending in two slots (11,12) of the feed reel. The lower part of the dog has a slot (9) in which the drive shaft pin (7) of the typewriter engages. Power transmission thus takes place from the drive shaft (8) via the dog (3) to the feed reel (1).

3 Claims, 3 Drawing Sheets

FEED MEANS FOR CARBON RIBBON

FIELD OF THE INVENTION

The present invention relates generally to typewriters and, more particularly, to a feed arrangement for carbon ribbon in typewriters.

BACKGROUND OF THE INVENTION

Carbon ribbon cartridges intended for typewriters include a feed reel about which the ribbon runs. In fitting the the cartridge to the typewriter, the feed reel is mated with a drive shaft in the typewriter so that the reel will be rotatably connected to the drive shaft, whereby the ribbon will be stepwise advanced in the movement of the drive shaft and feed reel.

In using ribbon cartridges in typewriters, there may be problems in fitting the cartridge into the typewriter due to the symmetrical axis of the reel not always being centered or coinciding with the symmetrical axis of the drive shaft in the typewriter itself. This is because the cartridge casing is generally attached to the typewriter and the dimension of the casing does not exactly agree with the distance between the symmetrical axis of the drive shaft and the locking position of the cartridge in the typewriter, due to the tolerances on the dimensions. This can cause a certain amount of deviation between the symmetrical axes of the feed reel and the drive shaft, thus causing eccentricity. The result will be increased wear on the drive shaft and feed reel, jerky advancing movement and increased frictional torque.

OBJECTS AND SUMMARY OF THE INVENTION

The present invention primarily intends to solve the above mentioned problems in typewriters and is characterized in that the feed reel includes an axially and radially movable part, a so-called dog, which is axially spring biased. The dog functions as a coupling between the drive shaft and feed reel.

An object of the present invention is accordingly to provide a feed means for carbon ribbons in a typewriter ribbon cartridge which gives flexible power transmission between drive shaft and feed reel in the cartridge. The invention is characterized by the disclosures in the following claims.

BRIEF DESCRIPTION OF DRAWINGS

The invention will now be described in more detail, with reference to the accompanying drawing wherein.

DETAILED DESCRIPTION OF A PREFERRED EMBODIMENT

Figure 1B:
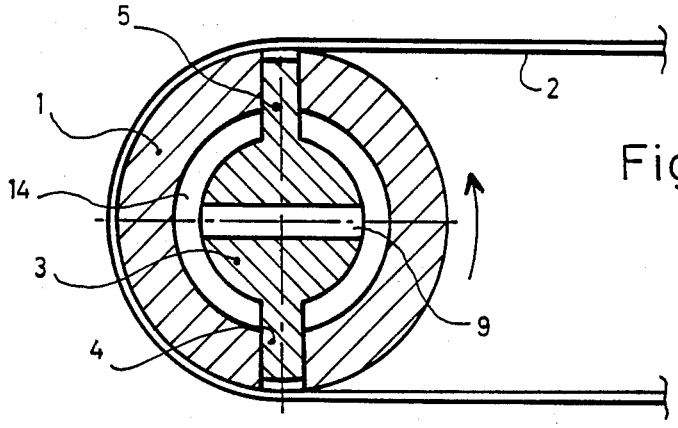
FIG. 1*b* is a cross sectional view of the feed means taken along line A—A of FIG. 1*a;*
Figure 1A:
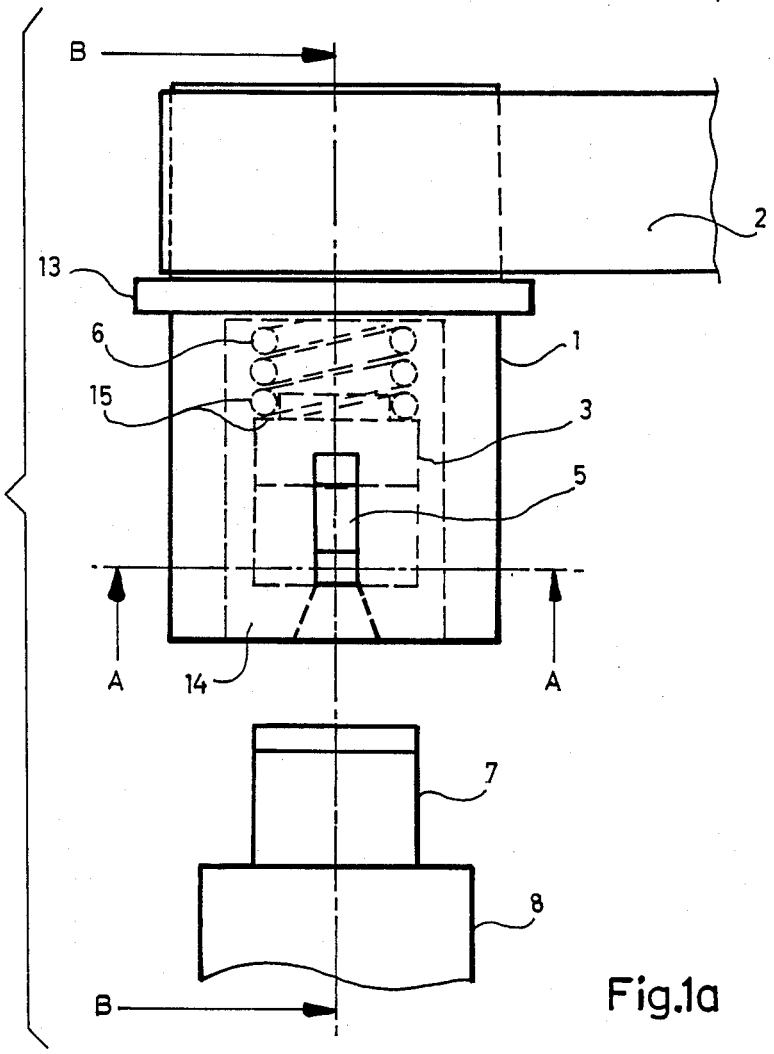
FIG. 1*a* is a longitudinal view of a feed means in accordance with the invention.
Figure 2B:
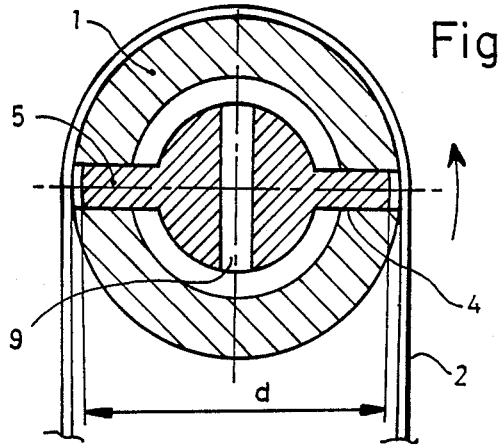
FIG. 2*b* is a cross sectional view of the feed means taken along line C—C of FIG. 2*a;*
Figure 2A:
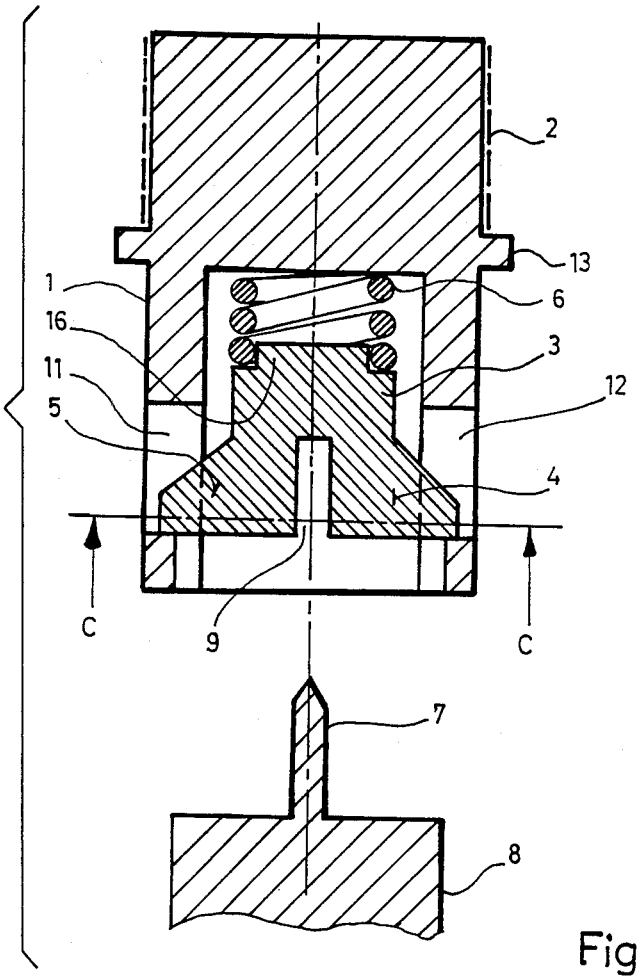
FIG. 2*a* is another longitudinal view of the feed means according to FIG. 1*a* taken along line B—B of FIG. 1*a;*

In FIGS. 1 and 2 the feed means in accordance with the invention is more closely illustrated for the same position of the drive shaft, i.e. the latter has not turned.

A cylindrical body 1 forms the feed reel itself for the carbon ribbon 2 of the typewriter. The reel 1 is formed with a circumferential flange 13 forming an abutment for the carbon ribbon 2 so that it is not removed, or does not glide, downwards during the rotational movement of the reel 1. The lower part of the reel is formed with a cylindrical cavity 14 for accommodating a cylindrically shaped dog 3. As will be seen from section A—A, the dog is provided with two diametrically opposing, projecting wings or flanges 4 and 5. The reel 1 is also provided with two similarly diametrically opposing slots 11 and 12 (FIG. 2) the width of which is insignificantly greater than the width of the flanges 4 and 5. Furthermore, a spring 6 is placed between a shoulder 15 at the upper part of the dog 1, whereby the upper portion of the spring engages against the "ceiling" of the cavity 14 in the vicinity of the flange 13.

As will be most clearly seen from FIG. 2, both the slots 11, 12 have a certain length in the vertical direction, the lower defining surface of the reel 1 forming an abutment for the dog 3 under the action of the spring bias. The preferably cylindrically shaped upper portion 16 has a diameter which is suitably selected such that there is a given gap between its circumferential surface and the lowest turn 6*a* of the spring. In addition, the dimension (d) of the flanges 4, 5 is selected such that these do not project out from the circumferential surface of the feed reel through the openings 11, and 12, but at the same time so they reliably enagage against the abutment surfaces 17, 18 at the lower end portion of the feed reel, (compare FIGS. 3 and 4).

In the embodiment example illustrated here, the drive shaft 8 is provided with a pin 7 which has a conical upper portion, to facilitate the accommodation of the pin in a slot 9. The cavity 14 for the dog 3 has a width which is suited to the width of the pin 7. The slot 9 on the dog has a width which is somewhat greater then the width of the cross section (according to FIG. 2) of the pin 7.

Figure 3:
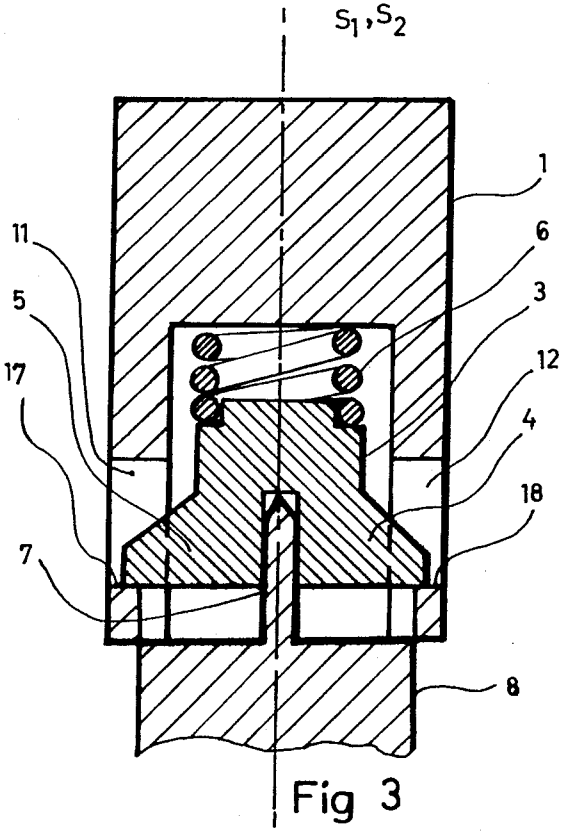
FIG. 3 is a longitudinal section view of the feed means in accordance with the invention in a position mating with the drive shaft.

FIG. 3 illustrates the feed means when it is fitted to the drive shaft pin 7 and engages against the shaft 8. In the case according to FIG. 3, the eccentricity is zero, i.e. the symmetrical axes $S_1$ and $S_2$ of the drive shaft and feed reel coincide. The rotational movement of the drive shaft 8 is then transmitted via the pin 7 to the dog 3 and to the feed reel via both flanges 4,5 engaging against the flat vertical surfaces of the openings 11, 12. With the implementation and fitting of the dog 3 described above, it will also be movable laterally during the rotational movement, by the flanges 4,5 being able to slide on the bottom surfaces of both openings 11, and 12. In addition, the dog 3 is movable in height under the action of the spring bias.

Figure 4:
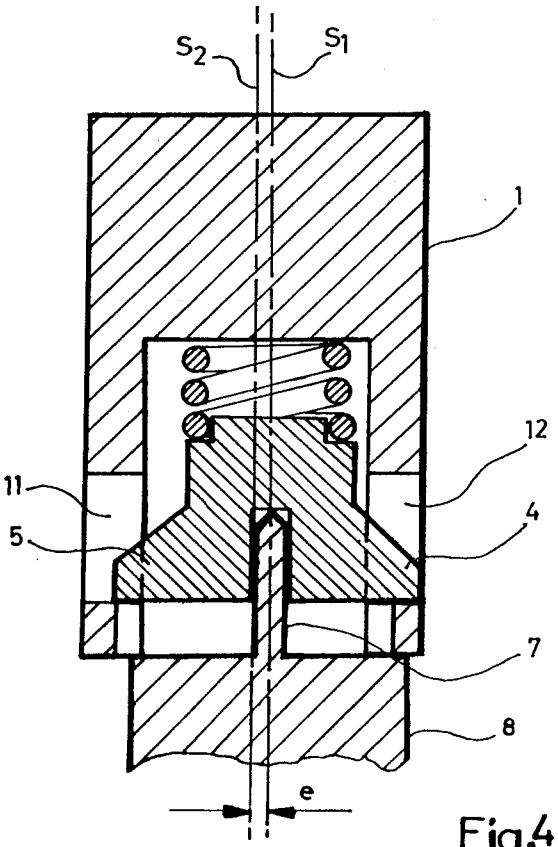
FIG. 4 is a longitudinal sectional view of a mating position according to FIG. 3, but with a certain amount of eccentricity between drive shaft and feed reel.

FIG. 4 illustrates the feed means mating with the drive shaft with a certain amount of eccentricity between the drive shaft and reel which is illustrated by the distance $e=0$ between the respective symmetrical axes $S_1$ and $S_2$. The dog 3 will thus be displaced a distance laterally, but the dimensioning is such that the left hand flange 5, illustrated in the position according to FIG. 4, is still in reliable enagagement in the opening 11. For a rotation of half a revolution of the feed means, the dog will glide horizontally so that the flange 4 has become displaced a distance in towards the center in the opening 12 but so that it still engages reliably in this opening for transmitting the rotational movement.

The function of the dog 3 also enables a certain amount of skew in the reel 1 relative the drive shaft 8, i.e. the symmetrical axes $S_1$ and $S_2$ may assume a given angle to each other.

The proposed feed means thus comprises a feed reel 1 which has a cavity 14 in its lower part accommodating an axially and radially movable dog 3, which is axially spring biased. The dog 3 accompanies the rotational movement of the feed reel 1 practically without play. The dog 3 thus functions as a shaft coupling allowing eccentricity between the coupled shafts, which in this case are the feed reel 1, which is a part of the cartridge, and the drive wheel 8, which is a part of the typewriter. With the implementation described above, there is a power transmission which is practically free from play between the drive wheel 8 and the feed reel 1, which in turn enables uniform ribbon feed and thereby short feed length and good ribbon economy. The implementation also facilitates fitting the cartridge into the typewriter, since the spring biased dog 3 is thrust upwards if its slots 9 is not in the same angular position as the drive wheel pin 7. The dog 3 thus constitutes a resilient obstacle. The coupling between the drive wheel pin 7 and the slot 9 takes place after turning the drive wheel at most half a revolution.

Different embodiments of the dog are possible. For example, the coupling between the drive shaft and dog does not need to be a slot or groove, but may be a hole with sufficient diameter, depending on the execution of the drive shaft tongue. In addition, the appearance of the flanges on the dog can be varied, etc. Thus, while the invention has been illustrated and described in accordance with a preferred embodiment, it is recognized that variations and changes may be made and equivalents employed herein without departing from the invention as set forth in the claims.

What is claimed is:

1. An arrangement for feeding carbon ribbon held in a carbon ribbon cartridge comprising:

a cylindrically shaped reel having a central longitudinal axis and upper and lower axial ends, the upper axial end including a circumference adapted to engage the ribbon, the lower axial end including a cavity extending concentrically of the central longitudinal axis of the reel and at least two diametrically opposing first slots, the first slots having flat abutment surfaces;

a drive shaft having a central longitudinal axis and being provided for transmitting rotational movement to the reel; and transmission means for transmitting the rotational movement of the drive shaft to the reel, the transmission means including a cylindrical body having at least two radially extending projections disposed for movement within the first slots, engagement means for matingly receiving the drive shaft, and radial movement means for permitting radial movement of the transmission means to permit the transmission of rotational movement from the drive shaft to the reel when the central longitudinal axes of the drive shaft and reel are out of line with each other, said body including a second slot and the drive shaft including a tapered pin, the pin being engageable with the second slot without play therebetween to define said engagement means which connects the drive shaft to the transmission means.

2. The ribbon feeding arrangement as claimed in claim 1, wherein the body is resiliently arranged in the cavity for allowing a resilient axial movement of the body.

3. The ribbon feeding arrangement as claimed in claim 1, wherein the at least two projections comprise at least two flanges extending radially from the body to a distance sufficient to provide contact between the flanges and the abutment surfaces during radial movement of the transmission means.

* * * * *